United States Patent [19]

Dorr

[11] Patent Number: 4,530,077

[45] Date of Patent: Jul. 16, 1985

[54] EFFICIENT LOW COST TRANSDUCER SYSTEM

[75] Inventor: John A. Dorr, Crofton, Md.

[73] Assignee: Xecutek Corporation, Crofton, Md.

[21] Appl. No.: 496,158

[22] Filed: May 19, 1983

[51] Int. Cl.[3] ..... B06B 3/04

[52] U.S. Cl. ..... 367/140; 367/151; 367/104

[58] Field of Search ..... 73/642; 181/104, 151, 181/155, 175, 191; 310/335; 367/103, 104, 138, 140, 151

[56] References Cited

U.S. PATENT DOCUMENTS

| | | | |
|---|---|---|---|
| 2,216,949 | 10/1940 | Kellogg | 181/175 X |
| 3,028,752 | 4/1962 | Bacon | 73/642 |
| 3,243,768 | 3/1966 | Roshon, Jr. et al. | 367/151 |
| 3,262,307 | 7/1966 | Hart | 73/642 X |
| 3,532,182 | 10/1970 | Bouyoucos | 367/151 X |
| 3,742,442 | 6/1973 | Leyde et al. | 310/335 X |
| 3,965,455 | 6/1976 | Hurwitz | 310/335 X |
| 4,110,723 | 8/1978 | Hetz et al. | 367/104 X |
| 4,146,869 | 3/1979 | Snyder | 367/151 X |
| 4,184,562 | 1/1980 | Bakamjian | 181/104 |
| 4,201,971 | 5/1980 | Saglio | 367/151 X |

*Primary Examiner*—Richard A. Farley
*Attorney, Agent, or Firm*—Jim Zegeer

[57] ABSTRACT

A low cost, efficient, ultrasonic transducer and method comprises a narrow beam electrostatic transducer and a beam transformer operated in air for expanding the emitted beam of the electrostatic transducer relative to a single axis. The beam transformer is a sonic reflecting surface spaced from the ultrasonic beam generator and within the near field thereof and having a geometric surface in which all points of said surface are generated by the revolution of a line about a fixed axis which is normal to the plane of the electrostatic transducer. A partial surface of a cone, the axis preferably being offset from the axis of the narrow beam electrostatic transducer and placed in the near field thereof transform the narrow beam to a broad beam with the beam transformer being an effective coupling element for the emitted beam and the return echo for ranging systems which are both efficient and easy to produce and do not have significant alignment problems. Acoustic energy absorbing material can be used to bound the perimeter of the reflecting surface to better define and control the beam in cross section. The invention is particularly useful for ranging, guidance, and surveillance systems wherein an ultrasonic beam, narrow in one direction of propagation, is projected in air over a surface to detect range to an object, presence or absence of an object and its location and entrance of an object to a specified area under surveillance.

14 Claims, 7 Drawing Figures

EFFICIENT LOW COST TRANSDUCER SYSTEM

BACKGROUND OF THE INVENTION

The combination of an ultrasonic wave generator and curved or planar reflector is well known in the art as disclosed, for example, in Rosenberg et al. U.S. Pat. No. 2,480,199 wherein a pencil beam from a supersonic generator is reflected off a reflector designed to produce a radiation pattern simulating a particular radio object locating device. In Rosenberg et. al., the reflector convexly and concavely curved in two mutually perpendicular directions such that the radiated pattern curves to a focus at approximately the middle of the range to be covered to achieve a narrower beam width without the reflector. Bacon patent 3,028,752 discloses an ultrasonic testing apparatus in which the combination of a sonic generator-reflector produces a focused beam with a long liquid coupling gap and suggests using an electromechanical transducer for producing a beam of ultrasonic energy and a curbed reflector wherein the curved portion of the reflector may be a section of a sphere, cylinder, parabaloid of the revolution, section of a right circular cone with the time required for the beam to cover the length of the liquid couplet path being greater than the time required for the entire path within the solid object to be traverse by the beam. In Bouyoueces U.S. Pat. No. 3,532,182, a hydroaccoustic impulse generator comprises the reflector shaped as a pseudosphere converting impulse signals to a omnidirectional pattern. Finally, in Hurwitz U.S. Pat. No. 3,965,455 a compound reflector focuses a sonic beam to obtain a line of focus. These sonic generator-reflector systems are complex and/or expensive and do not satisfy or solve the problem of providing low cost beam expanders for narrow beam electrostatic transducers for ultrasonic ranging, guidance and surveillance systems which are efficient and easy to produce and do not have significant alignment problems. According to the present invention, a low cost electrostatic planer transducer element, such as a Polaroid electrostatic transducer, generates compression and rarefaction waves which are essentially perpendicular to its planar surface and hence the beam is relatively narrow. The Polaroid transducer produces a conical ultrasonic beam at 50 kHz that is approximately 10 degrees wide. The object of the present invention is to provide a low cost beam transformer and method for such a transmitted wave and to couple the weaker return pulse energy to the transducer for detection. For this purpose, a beam transformer is combined with the planar electrostatic transducer for converting the narrow parallel beam of such a transducer to a beam which is broad along one axis and narrow along a transverse axis. The beam transformer is a reflecting surface, preferably a 45 degree conical reflector, placed in the near field from the electrostatic beam generator and having a geometric surface in which all points of the surface are generated by the revolution of a straight line about a fixed axis which is normal to the plane of said electrostatic transducer. A partial cone surface has proved to be ideal for beam expansion purposes. In a modification, accoustic absorbing material contiguously bounds the conical surface to better define and control the transmitted beam.

Therefore, the basic object of the invention is to provide an improved, low cost accoustic transducer for ranging, guidance and surveillance system.

BRIEF DESCRIPTION OF THE DRAWINGS

The above and other objects, advantages and features of the invention will be better understood when considered with the following specification and drawings wherein.

DETAILED DESCRIPTION OF THE INVENTION

Figure 1:
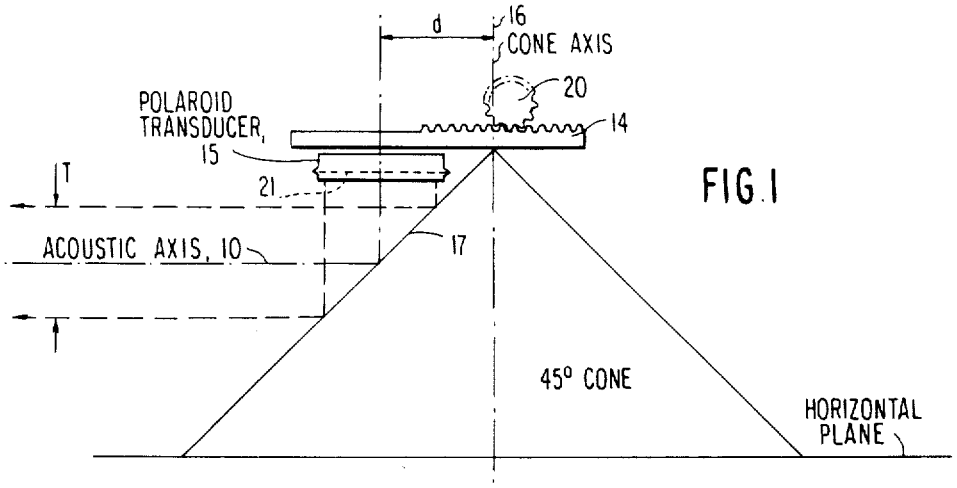
FIG. 1 is a side elevational view of a preferred embodiment of the invention.

As shown in FIG. 1, a planar electrostatic accoustic transducer or generator 15 which, in the preferred embodiment, is a Polaroid corporation type electrostatic transducer, produces a conical electrosonic beam at 50 kHz that is approximately 10 degrees wide. Transducer 15 is supported on an adjustable frame 14 so that it is laterally adjustable relative to the axis 16 of beam transformer 17. Beam transformer 17 is a 45 degree cone reflector (90 degree apical angle) that is placed in the near field of the transducer 15 and the resulting beam acoustic axis lies in a plane normal to the axis of the cone (a horizontal plane as shown in FIG. 1) and is in the direction of the displacement D (D=zero), the resulting beam is omnidirectional in the normal plane; and when the displacement is very large (D=infinity), the resulting beam shape closely approximates the shape of the undisturbed transducer beam. The −3 db beam width in the plane contain the reflective accoustic axis and the axis of the cone (the vertical plane) varies from about 10 degrees at D=infinity to about 20 degrees at D=zero. The transformed beam widths are unpredictable only in proportion to the unpredicatability of the beam width of the transducers 15 themselves. To produce a 40 degree beam in the horizontal plane, for projection over a touch panel surface, for example, the displacement should be approximately one inch (D=1"). The consequent beam width in the vertical plane is no more than 15 degrees and consequently, the resulting loss in signal to noise ratio is no more than 20 log (10/15)=−3.5 db. The Polaroid corporation type transducer 15 features a low Q (about 5.5) and therefore is very suitable for broadband (high resolution) operation.

Adjustment of the position of transducer 15 relative to the axis 16 of cone 17 is by means of a rack and pinion arrangement generally indicated as 20 in FIG. 1. In FIG. 1, since the transducer in this embodiment is always positioned on one side of the cone, the right side of the cone may be physically eliminated. The geometric surface upon which the acoustic reflection takes place therefor has all points thereof in a surface which is generated by the revolution of a straight line about a fixed axis 16 which is normal to the plane of the electrostatic transducer. In FIG. 1, the transducer element 15 is shown as including a planar element 21 which generates compression and rarefaction waves which are essentially perpendicular to its planar surface and hence the beam is relatively narrow.

Figure 2:
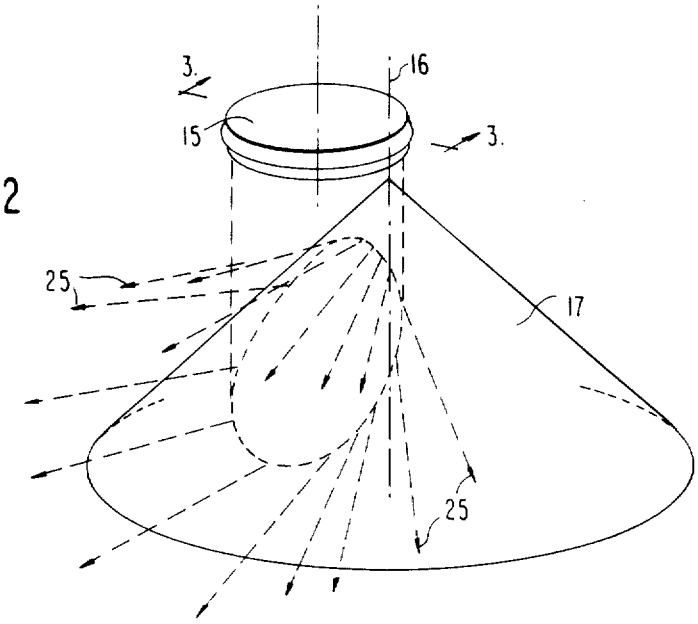
FIG. 2 is a partial isometric schematic view of the preferred embodiment of the invention.
Figure 3:
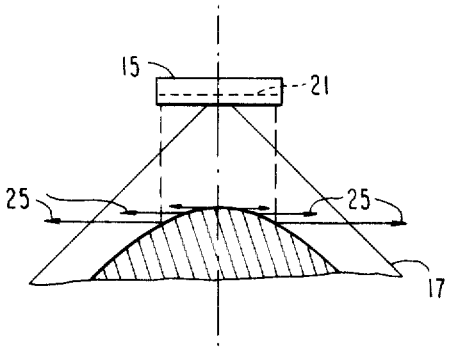
FIG. 3 is a schematic illustration of a section through lines 3—3 of FIG. 2.

As shown in FIG. 2, the projection of the planar element of transducer 15 upon the conical surface 17 causes the points of impingement of the beam from the planar surface of element 21 in transducer 15 to be reflected at 90° angles, with the curvature of the surface expanding the beam but only in the direction of curvature. The "thickness" of the beam T in the vertical direction (as illustrated with reference to FIG. 1), is unaffected by the beam transformer 17. As shown in FIG. 3, beam expansion is only in a horizontal plane and the vertical plane is substantially unaffected. In FIG. 3, the section line 7 is through a portion of the transducer 15 with the planar element indicated as 21 and the curved line 22 is the projection of a line through section line 3 upon the conical surface 21. The emitted or transmitted beam 25 is transmitted along the acoustic axis which in this embodiment is horizontal. However, it will be appreciated that the acoustic axis may be vertical, horizontal or at any angle so that the beam is essentially a thin wide beam. The vertical position of the beam may be adjusted simply by a lateral adjustment of the transducer relative to the reflecting surface or vice versa. Moreover, by revolving the transducer relative to the conical surface, the beam may be used to scan a much larger area.

Figure 4:
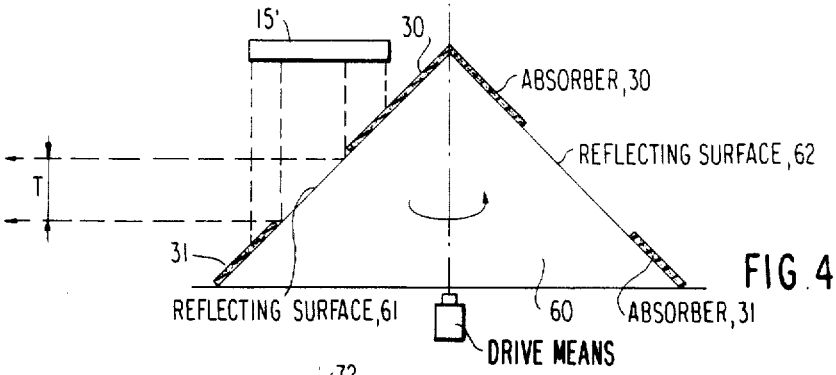
FIG. 4 is a side elevational view of a further embodiment of the invention.

In FIG. 4, portions of the conical surface 40 under the projection of the transducer 15' is bounded or delimited by acoustic absorber 30, 31 to better define and control the boundary of the acoustic beam relative to the acoustic axis 10. Absorbers 30, 31 can be a thin layer of open cell foam felt, etc. While this results in a loss of some of the sonic energy generated by transducer 15', there are applications in which a close definition of the vertical height (relative to FIGS. 1 and 2) and lateral width of the beam is important. The use of the acoustic absorbing material absorbs impinging ultrasonic energy and prevents unwanted reflections and provides a better perimetrical definition of the boundary of reflecting surface 40 of the beam transducer. In FIG. 4, one portion of the cone 60 may have a reflecting surface 61 of one specific width and the opposite side of the cone 60 may have a reflecting surface 62 which is wider or of any predetermined or given configuration so that the beam configuration can be changed simply by rotating the cone 60 or providing relative rotation between the cone 60 and the electrostatic transducer 15'.

Figure 5:
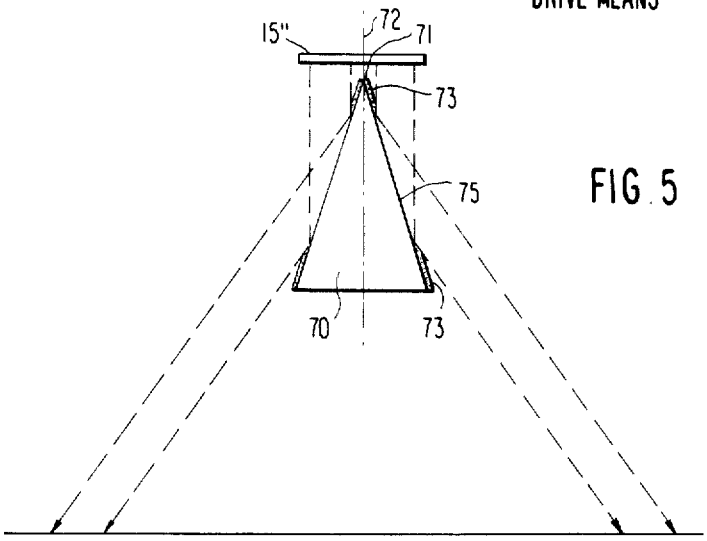
FIG. 5 is a side elevational view of a further embodiment for producing a hollow conical beam, for surveillance of a large space such as a room, warehouse, etc.

Another embodiment of the invention is shown in FIG. 5. In this case, the cone 70 is less than a 90 degree cone and the planar electrostatic transducer 15' is positioned directly over the apex 71 of the cone 70 with the planar element in the electrostatic transducer 15'' being substantially normal or orthogonal to the axis 72 of the cone. In this case, the small or acute angled cone 70 provides a reflecting surface 75 such that the angle of impingement is the angle of reflection, producing a hollow conical ultrasonic beam which can be very useful for survelience of large rooms, warehouses and the like. In this case, acoustic material 73 can also be located on the cone 70 so as to provide a better definition of the area to be under surveillance. It will be appreciated that more than one electrostatic transducer-beam transformer may be utilized, each covering or providing surveillance of a specified area. And the transducers may operate at the same frequency or at different frequencies and areas of overlap may be prevented by the use of acoustic material 73 blocking those areas where the beam is not desired.

Figure 6:
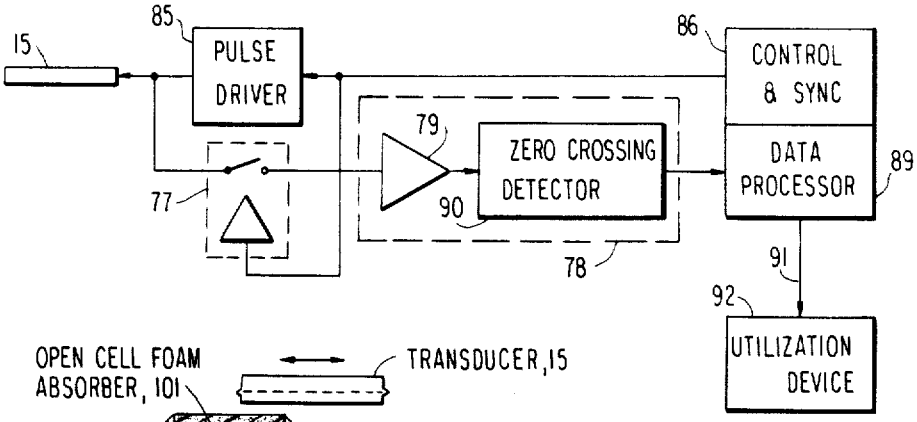
FIG. 6 PRIOR ART
FIG. 6 is a simplified schematic electronic block diagram for the conventional electronic utilization circuitry.

As shown in FIG. 6, the system electronics include an analog sonar pulse power or driver section 85 and a control and information output section 86. Sonar pulse power is delivered to the single electrostatic transducer 15, which is used for transmitting and receiving in response to synchronizing signals from the control and information output section. Electronic transmit receive switch 77-blocks the transmitted pulse energy from swamping the receiver circuitry. Echo, reverberation and noise signals are processed by the analog receiver section 73, which includes amplifier 79 and detector 90. The signals from detector 90 are supplied to the information output section 89 which may include microprocessor or data processor and supplies information on line 91 to a utilization device 92. In the case of ranging and/or guidance system, distances to object the timing between transmitted and received pulses can constitute the information output, or in the case of simple surveillance system, the presence or movement of an unknown object is provided as an output warning or indication.

Figure 7:
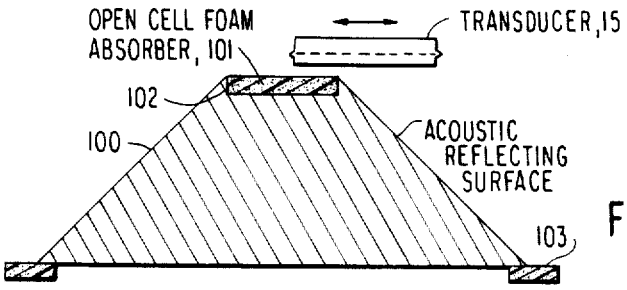
FIG. 7 is a cross section of a further embodiment of the invention.

FIG. 7 shows a further embodiment wherein a frustrum of a cone 100 has an ultrasonic absorber 101 in a well 102 so that when the beam from the ultrasonic transducer 15 impinges thereon, it is absorbed thereby. Likewise, with respect to absorber 103 at the base of the cone 100. The advantage of this arrangement is to enable use of a smaller dimension along the axis of the cone 100.

While there has been shown and described preferred embodiments of the invention, it is obvious that many modifications and variations of the invention are possible of the above teachings and it is to be understood that such obvious modifications as comes within the true spirit and scope of the appended claims are intended to be covered thereby.

What is claimed is:

1. Acoustic apparatus comprising in combination, a planar narrow beam electrostatic ultrasonic beam generator, a ultrasonic beam broadner, said ultrasonic beam broadner comprising an ultrasonic beam transformer having a conical reflecting surface spaced from said ultrasonic beam generator and in the near field thereof, said beam transformer having a geometric surface of revolution with all points on said surface being generated by the revolution of a straight line about a fixed axis which is normal to the plane of said electrostatic ultrasonic generator whereby said beam is expanded in one selected direction, and means mounting said planar narrow beam electrostatic ultrasonic beam generator such that the acoustic axis thereof is displaced from said fixed axis.

2. The invention defined in claim 1, including means for adjusting the relative position of said planar electrostatic ultrasonic beam generator relative to the said fixed axis of said conical reflecting surface of said beam transformer to control the amount of expansion of said beam.

3. The invention defined in claim 1, including ultrasonic absorbing means bounding said reflecting surface to define and control the shape of the expanded beam reflected from said conical beam reflecting surface.

4. The invention defined in claim 1, wherein said beam transformer is a cone, a plurality of ultrasonic beam transformer reflecting surfaces on said cone each including ultrasonic absorbing means contiguous to each edge of each said reflecting surface defining the shape of the reflected sonic beam from each said surface, respectively.

5. The invention defined to claim 4, including means for positioning said electrostatic ultrasonic beam transformer relative to a selected reflective surface.

6. The invention defined in claim 1, including ultrasonic absorbing means contiguous to and defining the boundaries of said conical reflecting surface of said beam transformer.

7. Ultrasonic apparatus comprising in combination, a planar electrostatic ultrasonic wave transducer for generating a narrow beam of ultrasonic energy, said planar electrostatic ultrasonic wave transducer having a central axis normal to the plane thereof, and means for spreading said beam in a single plane in one selected direction while said beam is maintained substantially parallel in a plane transverse thereto, said means for spreading including a beam transformer comprised of a portion of the surface of a cone, said portion of the surface of said cone being within the near field of said transducer and the projection area of the planar electrostatic ultrasonic wave transducer such that the conical axis of said surface of a cone and said central axis are not colinear.

8. The invention defined in claim 7, wherein said reflecting surface is bounded by ultrasonic absorbing material.

9. The invention defined in claim 7, including means providing relative rotation between said cone and said planar transducer.

10. The invention defined in claim 7, including at least a pair of reflecting surfaces on said cone, ultrasonic absorbing means bounding each said reflecting surface to thereby define a different beam pattern from said reflecting surface.

11. A method of producing a ultrasonic beam having predetermined boundaries in the atmosphere comprising, projecting a first sonic beam in a first direction upon a reflecting surface, said reflecting surface being angularly oriented to direct a portion of the energy of said first ultrasonic beam in a second direction as a second ultrasonic beam and absorbing ultrasonic energy of said first ultrasonic beam in all areas bounding said reflecting surface, wherein said second sonic beam is expanded in said predetermined direction by being projected upon the ultrasonic-energy-reflecting surface of a cone, and is constricted in a further predetermined direction normal to the first said predetermined direction by the absorption of the ultrasonic energy of said first ultrasonic beam in areas bounding said ultrasonic energy reflecting surface.

12. An unidirectional acoustic transducer system comprising, a planar narrow beam transducer having an acoustic axis normal to the plane thereof, a beam expander, said beam expander comprising a conical reflecting surface in the near field of said planar narrow beam transducer and defined by the projection of said transducer upon a surface of the revolution of a straight line about an axis parallel to and offset from said acoustic axis a selected distance to reflect and expand said beam a predetermined amount in a predetermined direction.

13. The unidirectional acoustic transducer system defined in claim 12, including means for adjusting the position of said planar narrow beam transducer relative to said surface.

14. The unidirectional acoustic transducer system defined in claim 13, wherein said planar narrow beam transducer is laterally adjusted in a plane normal to said acoustic and conical axes, respectively, to effect control over the expansion of said beam.

* * * * *